US010865956B1

(12) United States Patent
Shih

(10) Patent No.: US 10,865,956 B1
(45) Date of Patent: Dec. 15, 2020

(54) VEHICLE LIGHT

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 16/886,313

(22) Filed: May 28, 2020

(51) Int. Cl.

| | |
|---|---|
| ***F21S 41/20*** | (2018.01) |
| ***F21S 41/25*** | (2018.01) |
| ***F21S 41/148*** | (2018.01) |
| ***F21S 45/47*** | (2018.01) |
| ***F21S 41/32*** | (2018.01) |
| ***F21V 5/00*** | (2018.01) |
| ***F21V 29/76*** | (2015.01) |
| ***F21S 41/151*** | (2018.01) |
| *F21Y 115/10* | (2016.01) |

(52) U.S. Cl.
CPC ..... *F21S 41/285* (2018.01); *F21S 41/148* (2018.01); *F21S 41/151* (2018.01); *F21S 41/25* (2018.01); *F21S 41/322* (2018.01); *F21S 45/47* (2018.01); *F21V 5/007* (2013.01); *F21V 29/763* (2015.01); *F21Y 2115/10* (2016.08)

(58) Field of Classification Search
CPC ..... F21S 41/285; F21S 45/47; F21S 41/322; F21S 41/151; F21S 41/148; F21S 41/25; F21V 29/763; F21V 5/007; F21Y 2115/10
See application file for complete search history.

(56) References Cited

U.S. PATENT DOCUMENTS

| | | | | |
|---|---|---|---|---|
| 9,541,248 | B2 * | 1/2017 | Potter | F21S 41/148 |
| 9,651,211 | B2 * | 5/2017 | Potter | G02B 6/00 |
| 10,352,523 | B2 * | 7/2019 | Nishimura | H01L 33/58 |
| 10,697,601 | B2 * | 6/2020 | Courcier | F21S 41/663 |
| 2005/0141227 | A1 * | 6/2005 | Tsukamoto | F21S 41/155 362/487 |
| 2006/0285347 | A1 * | 12/2006 | Okada | F21S 41/321 362/516 |
| 2009/0091944 | A1 * | 4/2009 | de Lamberterie | F21S 43/243 362/516 |

* cited by examiner

*Primary Examiner* — Isiaka O Akanbi
*Assistant Examiner* — Glenn D Zimmerman
(74) *Attorney, Agent, or Firm* — Burris Law, PLLC

(57) ABSTRACT

A vehicle light includes a light output lens for refracting light beams outwardly and forwardly in a first direction and a plurality of optical systems. Each optical system includes a light emitting unit and a lens unit positioned relative to the light emitting unit in a second direction transverse to the first direction. The light beams emitted from the light emitting unit propagate in the second direction and are reflected in the lens unit, such that all the extension lines of the light beams reflected in the lens unit extend through a focal region centered at the focus of the light output lens, and then propagate outwardly from the light output lens in directions generally parallel to the first direction.

9 Claims, 8 Drawing Sheets

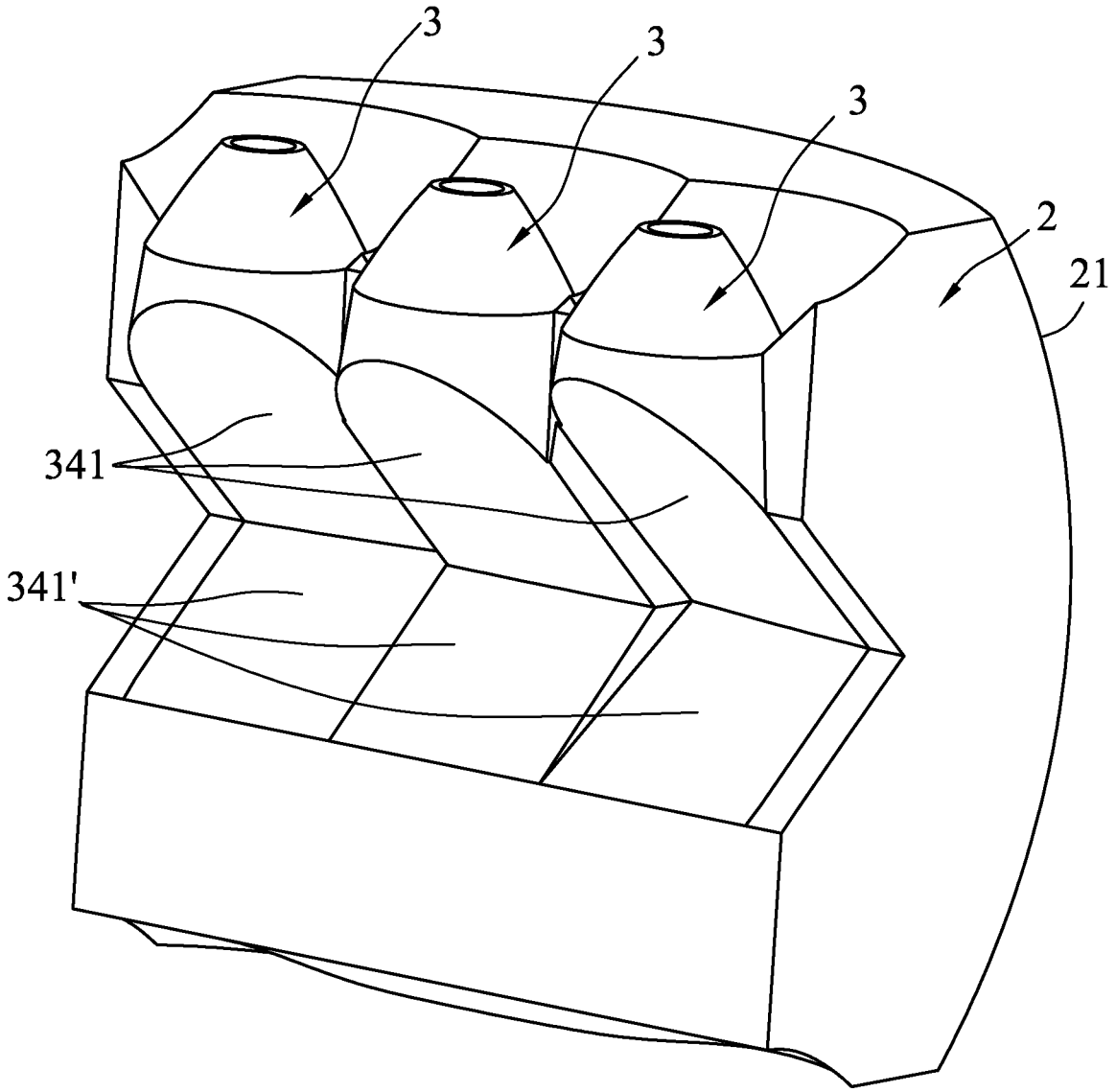
FIG.7
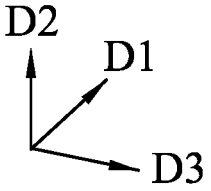

VEHICLE LIGHT

FIELD

The disclosure relates to a vehicle light, more particularly to a vehicle light for illumination or alarm.

BACKGROUND

Referring to FIG. 1, a conventional vehicle light is mounted on a vehicle (not shown) for illuminating the road area in front of the vehicle. The conventional vehicle light includes a light output lens 11, an optical lens 12 connected to the light output lens 11, a light emitting unit 13 and a base 14 for mounting of the light emitting unit 13. The light output lens 11 cooperates with the optical lens 12 to refract light beams emitted by the light emitting unit 13 such that the light beams propagate outwardly and forwardly in a front-rear direction.

The light output lens 11, the optical lens 12, the light emitting unit 13 and the base 14 of the conventional vehicle light are usually arranged along the front-rear direction and thus occupy a relatively large room in the front-rear direction on the vehicle. Further, to provide sufficient illumination intensity, the light emitting unit 13 is normally a high power light emitting element that generates a relatively large amount of heat during use.

SUMMARY

Therefore, an object of the disclosure is to provide a vehicle light capable of providing alleviating at least one of the drawbacks of the conventional vehicle light.

According to one aspect of the disclosure, a vehicle light is provided to include a light output lens and a plurality of optical systems. The light output lens is configured to refract a plurality of light beams such that the light beams propagate outwardly and forwardly of the light output lens in a first direction. The light output lens defines an optical axis that extends along the first direction and a first focus that permits the optical axis of the light output lens to extend therethrough, and has a light output surface that protrudes forwardly in the first direction.

Each of the optical systems includes a light emitting unit emitting the light beams and a lens unit positioned relative to the light emitting unit such that the light emitting unit and the lens unit are arranged along a second direction transverse to the first direction. For each of the optical systems, the lens unit is disposed nearer to the optical axis of the light output lens than the light emitting unit. The light beams emitted from the light emitting unit of each of the optical systems propagate in the second direction and are reflected in the lens unit, such that all the extension lines of the light beams reflected in the lens unit extend through a first focal region that is centered at the first focus, and then propagate outwardly from the light output lens in directions generally parallel to the first direction.

BRIEF DESCRIPTION OF THE DRAWINGS

Other features and advantages of the disclosure will become apparent in the following detailed description of the embodiments with reference to the accompanying drawings, of which:

FIG. 7 is a schematic perspective view of a vehicle light of a second embodiment according to the present disclosure.

DETAILED DESCRIPTION

Figure 1:
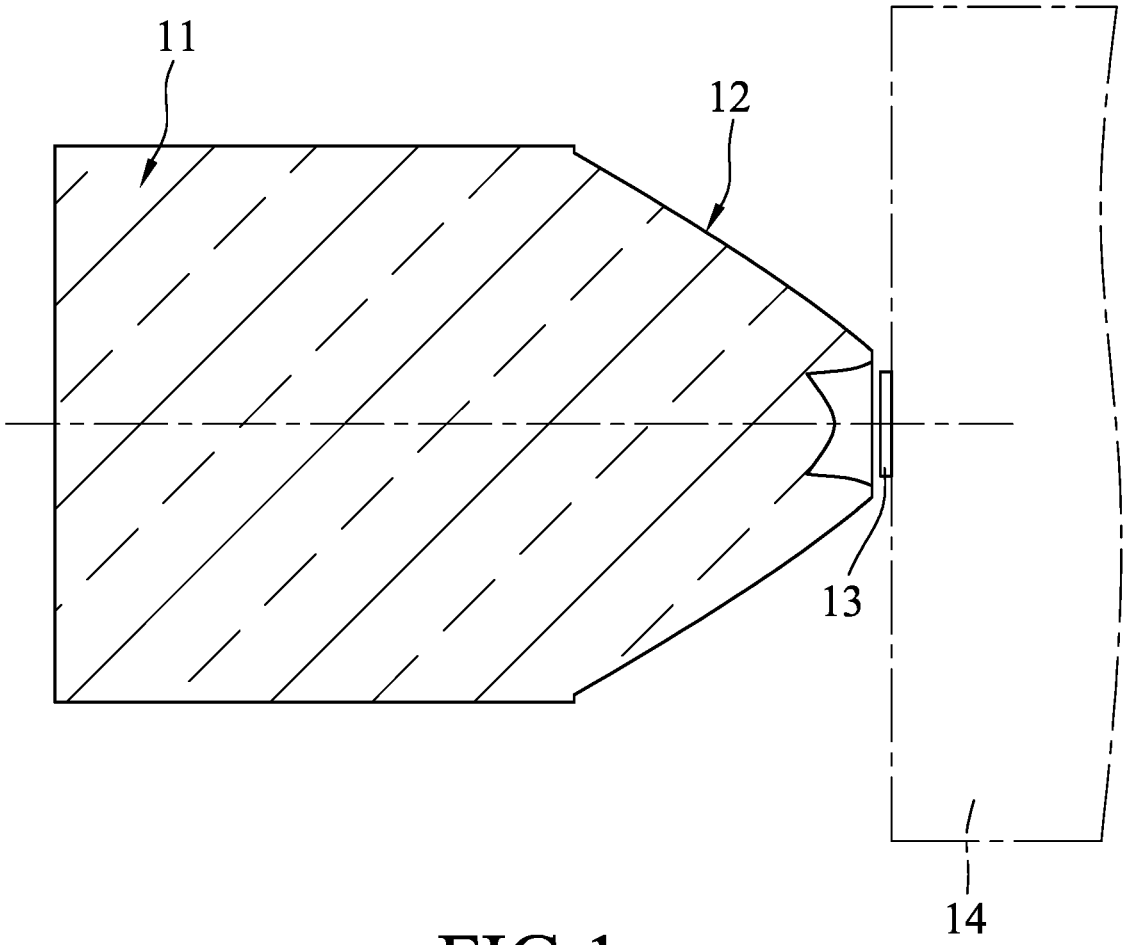
FIG.1 PRIOR ART
FIG. 1 is a schematic sectional view of a conventional vehicle light.
Figure 2:
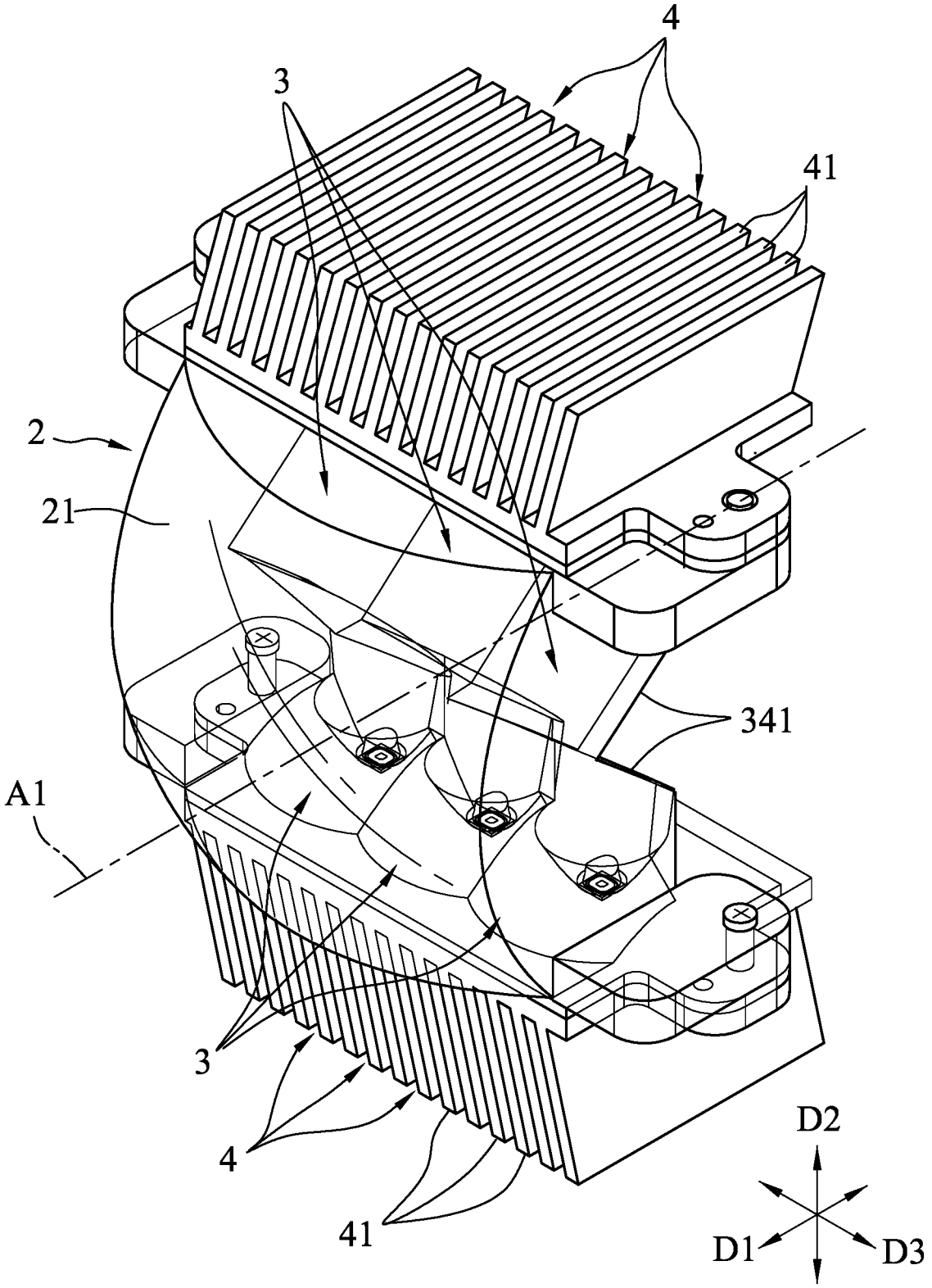
FIG. 2 is a schematic front perspective view of a vehicle light of a first embodiment according to the present disclosure, illustrating the vehicle light including a light output lens, and a plurality of optical systems.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 2 to 5, a vehicle light according to a first embodiment of the present disclosure is shown. The vehicle light is to be mounted on a vehicle (not shown) and includes a light output lens 2, a plurality of optical systems 3 connected to the light output lens 2, and a plurality of seat units 4 corresponding respectively in position to the optical systems 3.

The light output lens 2 is configured to refract a plurality of light beams emitted from the optical systems 3 such that the light beams propagate outwardly and forwardly of the light output lens 2 in a first direction (D1). The light output lens 2 defines an optical axis (A1) that extends along the first direction (D1), and a first focus 23 (see FIG. 5) that permits the optical axis (A1) of the light output lens 2 to extend therethrough, and has a light output surface 21 that protrudes forwardly in the first direction (D1).

Figure 3:
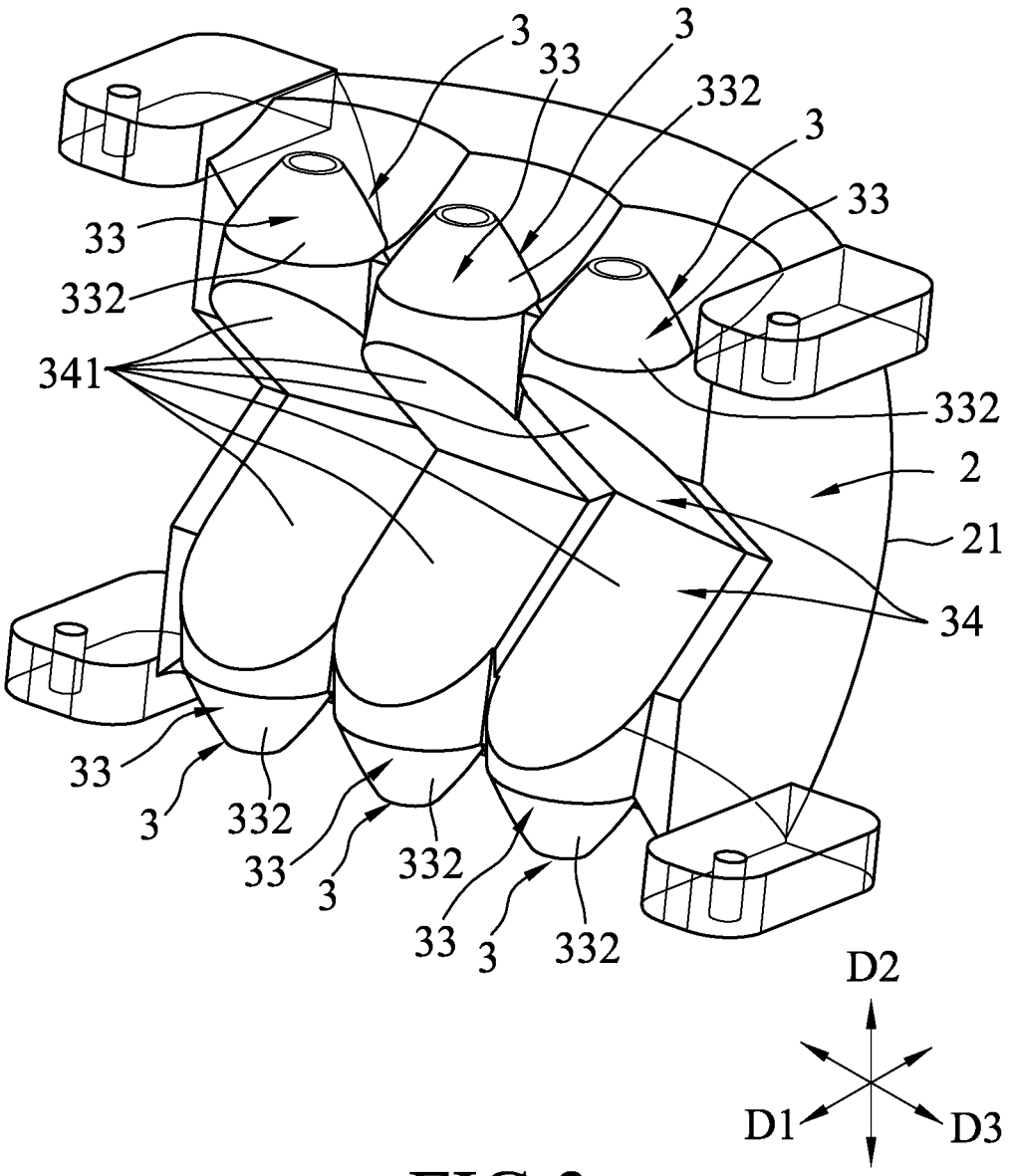
FIG. 3 is a schematic rear perspective view of the first embodiment.
Figure 4:
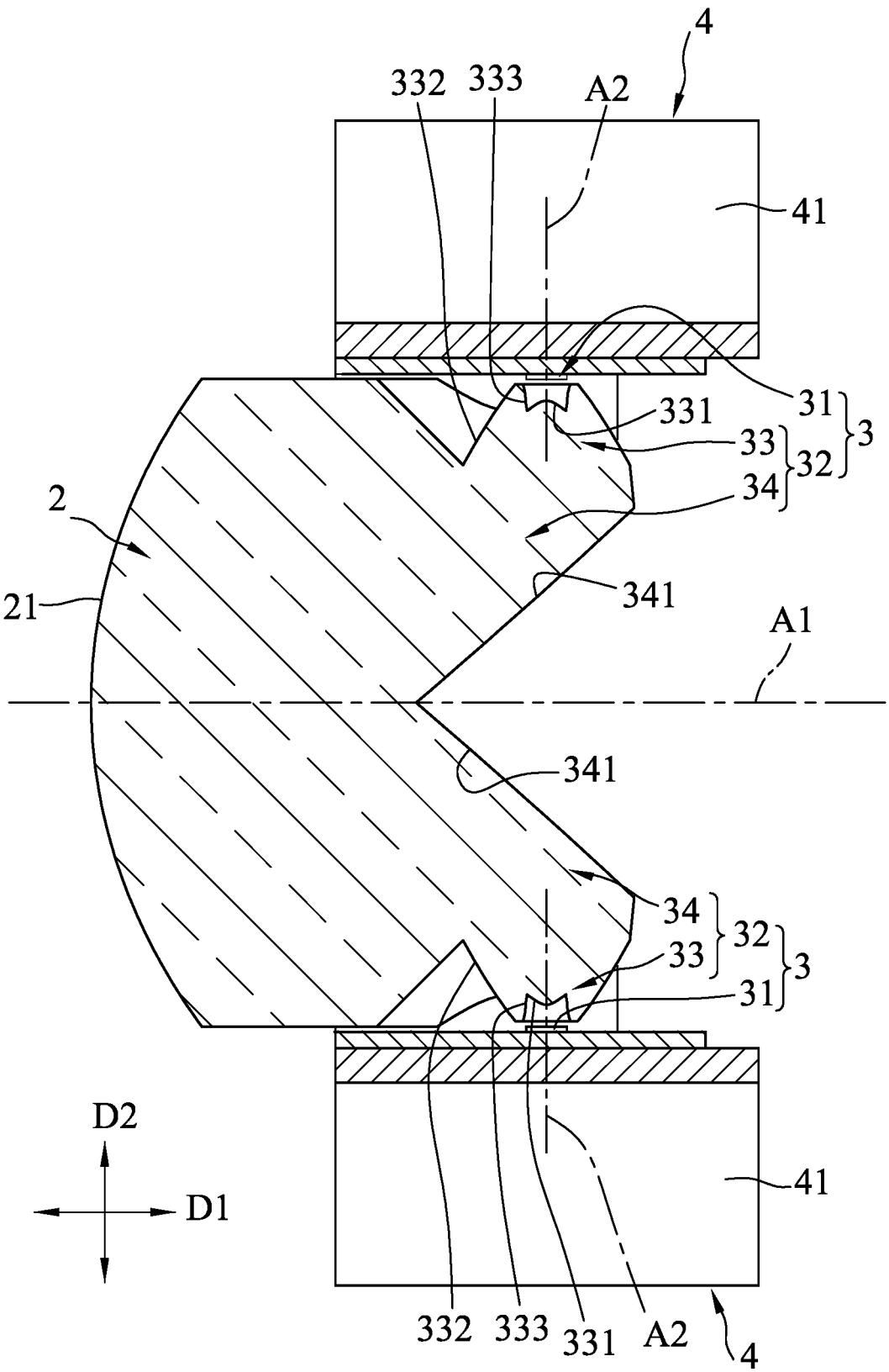
FIG. 4 is a schematic sectional view of the first embodiment.

Note that the seat units 4 are omitted in FIG. 3 for ease of illustration. As shown in FIGS. 3 and 4, the optical systems 3 include a plurality of optical system pairs each consisting of two of the optical systems 3 arranged along a second direction (D2) transverse to the first direction (D1). In this embodiment, the optical systems 3 include three of the optical system pairs, i.e., six of the optical systems 3, arranged along a third direction (D3) transverse to the first direction (D1) and the second direction (D2).

Each of the optical systems 3 includes a light emitting unit 31 emitting the light beams, and a lens unit 32 positioned relative to the light emitting unit 31, such that the light emitting unit 31 and the lens unit 32 are arranged along the second direction (D2). The lens unit 32 is disposed nearer to the optical axis (A1) of the light output lens 2 than the light emitting unit 31. Each light emitting unit 31 is a light emitting diode (LED) in this embodiment and can be any other light emitting element available in the market.

The light beams emitted from the light emitting unit 31 of each of the optical systems 3 propagate in the second direction (D2) and are reflected in the lens unit 32, such that all the extension lines of the light beams reflected in the lens unit 32 extend through a first focal region 22 that is centered at the first focus 23, and then propagate outwardly from the light output lens in directions generally parallel to the first direction (D1). According to optical principles, light beams emitted from a light source disposed at a focal point of a convex lens are refracted by the convex lens and then propagate outwardly of the convex lens to form parallel output light beams. Accordingly, light beams emitted from a light source disposed in the first focal region 22 are refracted by the light output lens 2 and then propagate outwardly of the light output surface 21 to form output light beams generally parallel to the first direction (D1).

The seat units 4 correspond respectively in position to the optical systems 3 such that each of the seat units 4 and a corresponding one of the optical systems 3 are arranged in the second direction (D2). Each of the seat units 4 includes a plurality of heat dissipating fins 41 extending in the first direction (D1), inclined relative to both of the second direction (D2) and the third direction (D3), and spaced apart from one another in the third direction (D3) such that heat generated by the light emitting unit 31 of the corresponding one of the optical systems 3 is dissipated by the heat dissipating fins 41.

Since the structures of the optical systems 3 are the same, only one of the optical systems 3 will be described in the following descriptions for the sake of brevity. The lens unit 32 includes a first lens 33 and a second lens 34 connected integrally to the first lens 33 in the second direction (D2) and connected integrally to the light output lens 2 in the first direction (D1). The first lens 33 has a convex profile and defines an optical axis (A2) of the first lens 33 that extends in the second direction (D2). The first lens 33 has a refracting surface 331, a frusto-conical first reflecting surface 332, and a connecting surface 333. The optical axis (A2) of the first lens 33 extends through the refracting surface 331. The first reflecting surface 332 surrounds the refracting surface 331 and is tapered away from the second lens in the second direction (D2). The connecting surface 333 surrounds the optical axis (A2) of the first lens 33 and interconnects the first reflecting surface 332 and the refracting surface 331.

The refracting surface 331 is configured such that light beams emitted by the light emitting unit 31 are refracted thereby such that the extension lines of the refracted light beams extend through a second focal region 334 that is centered at a second focus 335, which permits the optical axis (A2) of the first lens 33 to extend therethrough and which is located farther away from the light emitting unit 31 than the corresponding one of the seat units 4 in the second direction (D2).

The connecting surface 333 is configured to refract the light beams propagated into the first lens 33 toward and then reflected by the first reflecting surface 332, such that the extension lines of the refracted light beams extend through the second focal region 334 that is centered at the second focus 335.

The second lens 34 has a second reflecting surface 341 that extends from the first lens 33 toward the light output surface 21 of the light output lens 2 and away from the light emitting unit 31, and that is inclined relative to the optical axes (A1, A2) of the light output lens 2 and the first lens 33. In this embodiment, the second reflecting surfaces 341 of the optical systems 3 of each of the optical systems 3 is coated with an aluminum film for reflecting light beams. Note that any other coating material suitable for reflecting light beams may be employed in other embodiments of the present disclosure.

FIG. 4 illustrate one optical system pair consisting of an upper one of the optical systems 3 (see FIG. 5) and a lower one of the optical systems 3 (see FIG. 6), and substantial symmetric to each other with respect to the optical axis (A1) of the light output lens 2. The second reflecting surfaces 341 of the optical systems 3 of each optical system pair cooperate with each other to form a V-shaped recess opposite to the light output surface 21 in the first direction (D1).

Figure 5:
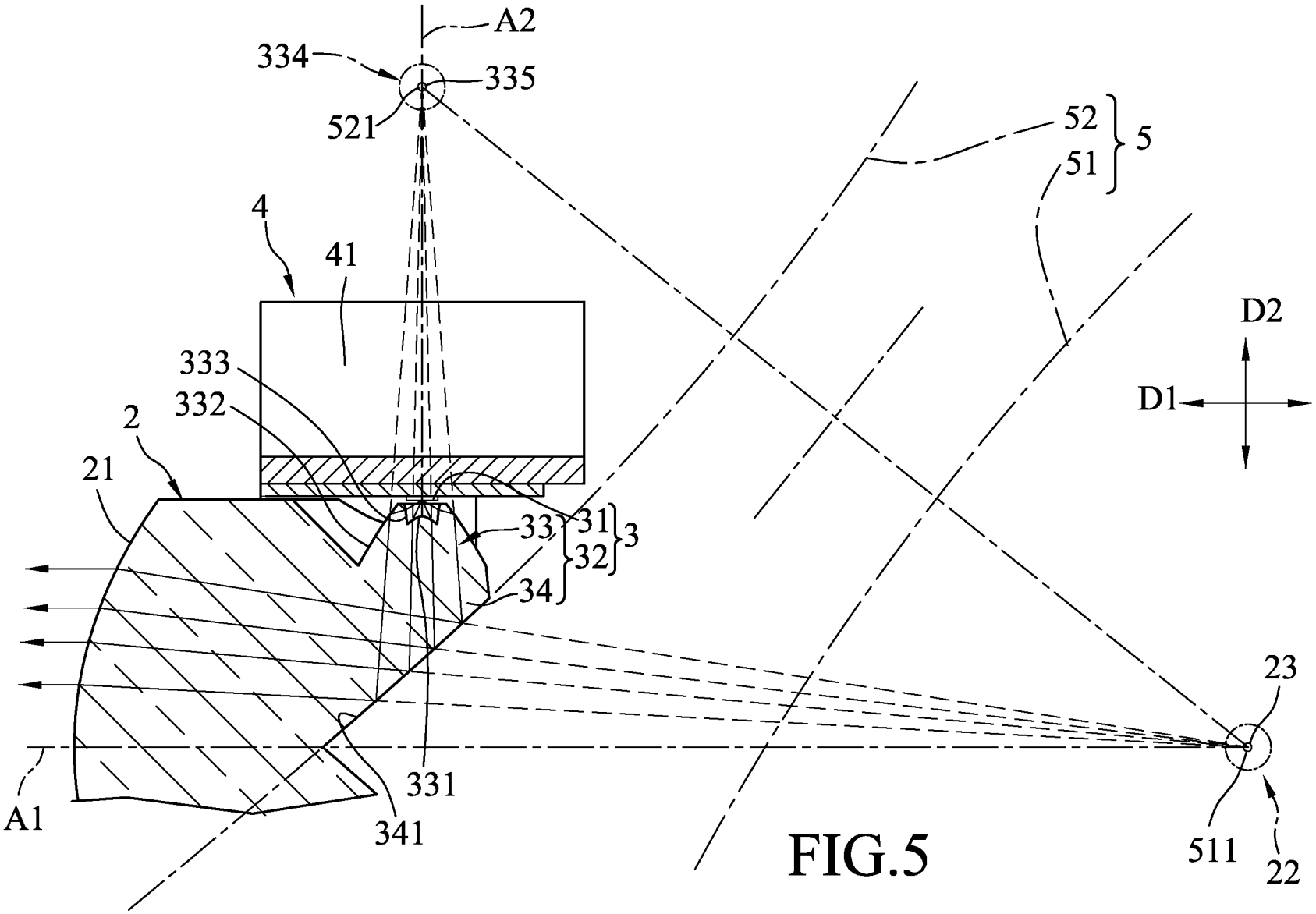
FIG. 5 is a fragmentary sectional view of an upper one of the optical systems of the first embodiment, illustrating paths of light beams emitted by a light emitting diode of the upper one of the optical systems.
Figure 6:
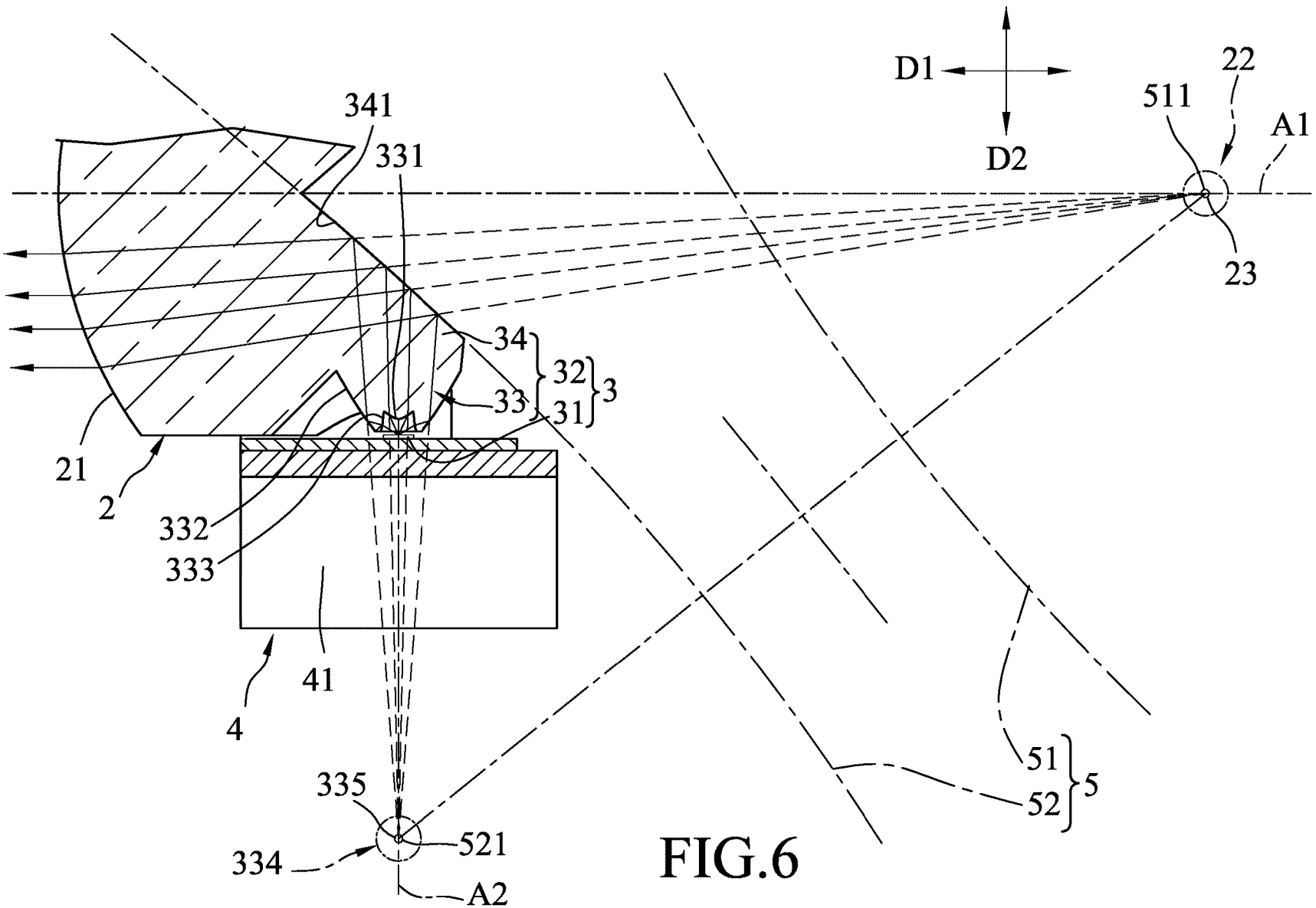
FIG. 6 is a fragmentary sectional view of an lower one of the optical systems of the first embodiment, illustrating paths of light beams emitted by a light emitting diode of the lower one of the optical systems.

The light output lens 2 and the lens unit 32 are configured such that the first focus 23 cooperating with the second focus 335 to define a two-sheeted hyperboloid 5. Note that only a portion of the two-sheeted hyperboloid 5 is shown in FIGS. 5 and 6. The two-sheeted hyperboloid 5 includes a first sheet 51 convex toward the light output surface 21 and a second sheet 52 concave toward the light output surface 21. The first sheet 51 defines a first sheet focus 511 located at the first focus 23 of the light output lens 2, while the second sheet 52 defines a second sheet focus 521 located at the second focus 335. Note that the second reflecting surface 341 coincides with a portion of the second sheet 52.

According to optical principles, light beams emitted from a light source disposed at one of the focal points of a two-sheeted hyperboloid, which is defined by the focal points and has first and second sheets, are reflected by one of the sheets corresponding to said one of the focal points and the extension lines of the reflected light beams extend through the other one of the focal points. In this embodiment, for each of the optical systems 3, a part of the light beams emitted by the light emitting unit 31 propagate into the first lens 33, are refracted by the refracting surface 331 and then are reflected by the second reflecting surface 341 to form a virtual image in the first focal region 22, and another part of the light beams emitted by the light emitting unit 31 propagate into the first lens 33, are refracted by the connecting surface 333, are reflected by the first reflecting surface 332 and then are reflected by the second reflecting surface 341 to form another virtual image in the first focal region 22. The virtual images serve as a virtual light source of the light emitting unit 31 of each of the optical systems 3, such that the light beams are deemed to be emitted by the virtual light source. The light beams deemed to be emitted from the virtual light source are reflected by the second reflecting surface 341, such that the extension lines of the reflected light beams extend through the first focal region 22 centered at the first focus 23 where the first sheet focus 511 is located. That is to say, the extension lines of the light beams emitted by the light emitting unit 31 of each of the optical systems 3 propagating into the first lens 33, refracted and reflected by the first and second lens 33, 34 eventually extend through the first focal region 22 that is centered at the first focus 23, and then propagate outwardly from the light output lens 2 in directions generally parallel to the first direction (D1) since the first focus 233 is located at the focal point of the light output lens 2.

By virtue of the abovementioned configurations of the optical systems 3, each of the optical systems 3 occupies a relatively small room in the first direction (D1) as compared to the conventional vehicle light shown in FIG. 1. Additionally, the seat units 4 that correspond respectively in position to the optical systems 3 in the second direction (D2) for dissipating heat generated thereby are arranged in such a manner that the seat units 4 are not blocked by the light output lenses 2 and are visible in front of the vehicle light to provide a scientific and fashionable visual appearance.

The light beams emitted by the light emitting unit 3 of each of the optical systems 3 are redirected to the first focal region 22 to form a virtual light source, so that the light beams propagate outwardly from the light output lens 2 in directions generally parallel to the first direction (D) and are relatively concentrated and collimated. In this way, rather than using a high power LED, a plurality of low power consumption LEDs can be employed as the light emitting units 31, and thus heat generated by each of the light emitting units 31 is relatively little while providing a sufficient illumination intensity. Additionally, the color of the light emitted by the light emitting unit 3 may be modified to provide different illumination effects such as turn signal. Note that in other embodiments, the light pattern provided by the vehicle light may be varied to meet design demand or the traffic regulations. For example, for each of the optical systems 3, the extension lines of the light beams emitted by the light emitting unit 31 propagating into, refracted by the lens unit 32 and then reflected by the second reflecting surface 341 are to be concentrated at the first focal region 22 that is a sphere centered at the first focus 23 and having a radius ranging from 3 millimeters to 5 millimeters.

Referring to FIG. 7, a second embodiment of the vehicle light according to the present disclosure is shown. The second embodiment is similar to the first embodiment and the differences therebetween reside in the following. In the second embodiment, the number of the optical systems 3 is three and the optical systems 3 are arranged along the third direction (D3). Each of the optical systems 3 of the second embodiment further includes an auxiliary reflecting surface 341' cooperating with a corresponding one of the second reflecting surfaces 341 that is aligned therewith in the second direction (D2) to form a V-shaped recess opposite to the light output surface 21 in the first direction (D1) for reflecting the light beams emitted by the light emitting units 31.

Since the number of the light emitting units 31 is reduced to three, which is half of that in the first embodiment, the illumination intensity of the vehicle light of the second embodiment is half of that of the first embodiment. Further, the structure of the light output lens 2 is not altered and the light patterns can be provided by the second embodiment are the same as those provided in the first embodiment.

Figure 8:
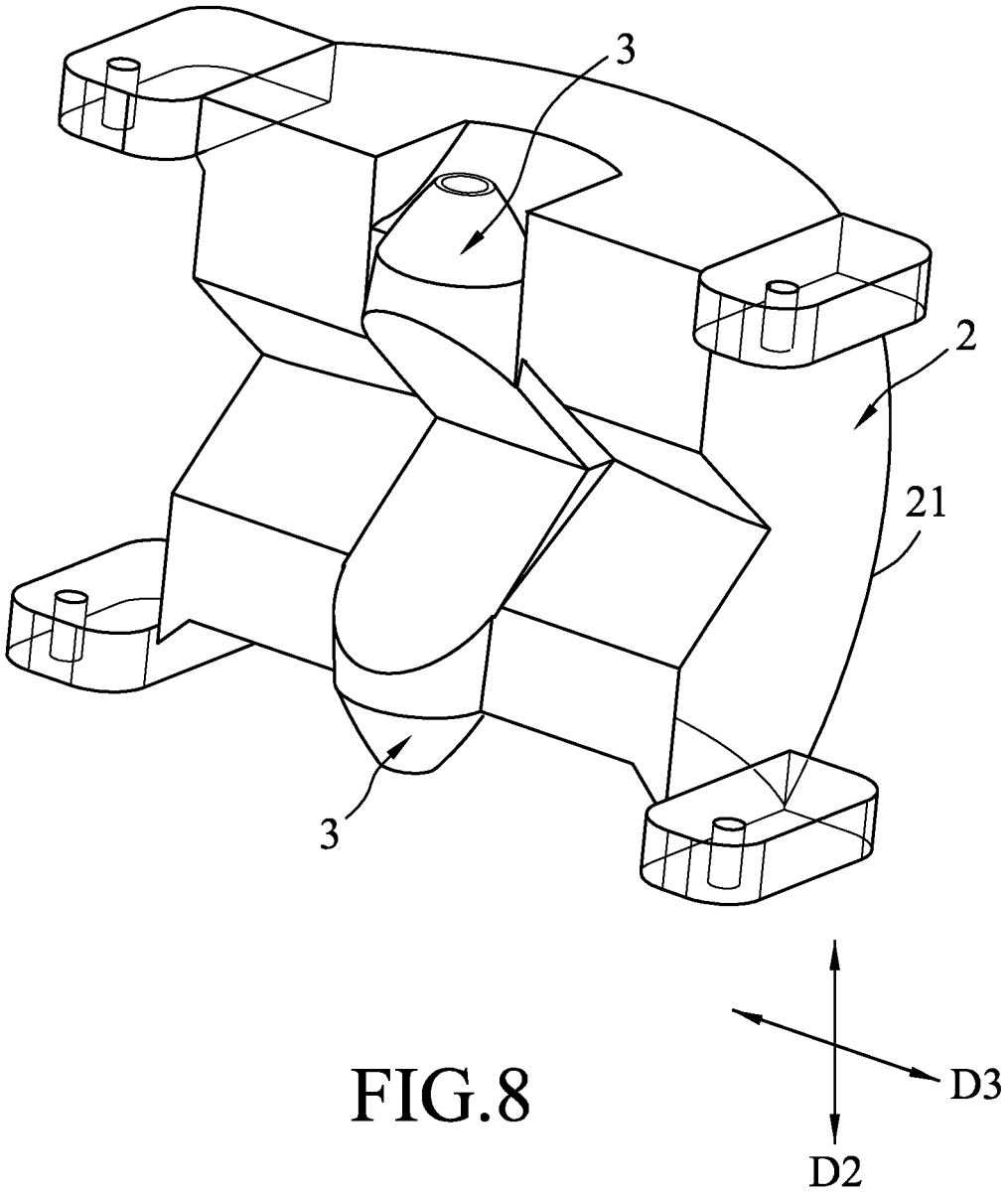
FIG. 8 is a schematic perspective view of a vehicle light of a third embodiment according to the present disclosure.

Referring to FIG. 8, a third embodiment of the vehicle light according to the present disclosure is shown. The third embodiment is similar to the first embodiment and the differences therebetween reside in the following. In the third embodiment, the number of the optical systems 3 is two and the optical systems 3 are arranged along the second direction (D2).

Similar to those described in the second embodiment, the number of the light emitting units 31 of this embodiment is reduced to two, which is one-third of that in the first embodiment, and thus the illumination intensity of the vehicle light of the third embodiment is one-third of that of the first embodiment. Further, the structure of the light output lens 2 is not altered and the light patterns can be provided by the third embodiment are the same as those provided in the first embodiment. Note that the arrangement and the numbers of the optical systems 3 are not limited to the examples described herein and may be modified according to different demands in other embodiments of the present disclosure.

To sum up, by virtue of the configurations of the light emitting unit 31 and the lens unit 32 of each of the optical systems 3 that are arranged along the second direction (D2), the dimension occupied by the vehicle light in the first direction (D1) can be reduced while the light beams emitted by the light emitting unit 31 are refracted and reflected by the lens unit 32 to propagate outwardly from the light output lens 2 in directions generally parallel to the first direction (D1) to provide sufficient illumination intensity.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A vehicle light, comprising:

a light output lens configured to refract a plurality of light beams such that the light beams propagate outwardly and forwardly of said light output lens in a first direction, defining an optical axis that extends along the first direction and a first focus that permits the optical axis of said light output lens to extend therethrough, and having a light output surface that protrudes forwardly in the first direction; and a plurality of optical systems, each of said optical systems including a light emitting unit emitting the light beam and a lens unit positioned relative to the light emitting unit such that said light emitting unit and the lens unit are arranged along a second direction transverse to the first direction, said lens unit being disposed nearer to the optical axis of said light output lens than said light emitting unit, the light beams that are emitted from said light emitting unit of each of said optical systems propagating in the second direction and being reflected in said lens unit, such that all the extension lines of the light beams reflected in the lens unit extend through a first focal region that is centered at the first focus, and then propagating outwardly from said light output lens in directions generally parallel to the first direction.

2. The vehicle light as claimed in claim 1, wherein, for each of said optical systems, said lens unit includes a first lens and a second lens connected integrally to said first lens in the second direction and connected integrally to said light output lens in the first direction, said first lens defining an optical axis of said first lens that extends in the second direction, and having a refracting surface through which the optical axis of said first lens extends, a frusto-conical first reflecting surface surrounding said refracting surface and tapered away from said second lens in the second direction, and a connecting surface surrounding the optical axis of said first lens and interconnecting said first reflecting surface and said refracting surface, said second lens having a second reflecting surface that extends from said first lens toward said light output surface of said light output lens and away from the light emitting unit and that is inclined relative to the optical axes of said light output lens and of said first lens, a part of the light beams emitted by said light emitting unit propagating into said first lens, being refracted by said refracting surface and being then reflected by said reflecting surface to form a virtual image in the first focal region, another part of the light beams emitted by said light emitting unit propagating into said first lens, being refracted by said connecting surface toward and reflected by said first reflecting surface, and being then reflected by said second reflecting surface to form another virtual image in the first focal region.

3. The vehicle light as claimed in claim 1, further comprising a plurality of seat units corresponding respectively in position to said optical systems such that each of said seat units and a corresponding one of said optical systems are arranged in the second direction, each of said seat units including a plurality of heat dissipating fins extending in the first direction, inclined relative to both of the second direction and a third direction transverse to the first direction and the second direction, and spaced apart from one another in the third direction such that heat generated by the light emitting unit of the corresponding one of said optical systems is dissipated by said heat dissipating fins.

4. The vehicle light as claimed in claim 2, wherein, for each of said optical systems, the extension lines of the light beams propagating toward said reflecting surface in said second lens extend through a second focal region that is centered at a second focus, which permits the optical axis of said first lens to extend therethrough, the part of the light beams emitted by said light emitting unit propagating into said first lens, being refracted by said connecting surface, and being then reflected by said first reflecting surface to form a virtual image in the second focal region, said light output lens and said lens unit being configured such that the first focus cooperating with the second focus to define a two-sheeted hyperboloid that includes a first sheet convex toward said light output surface and a second sheet concave toward said light output surface, said second reflecting surface coinciding with a portion of the second sheet.

5. The vehicle light as claimed in claim 2, wherein said optical systems are arranged along a third direction transverse to the first direction and the second direction.

6. The vehicle light as claimed in claim 2, wherein said optical systems include at least one optical system pair consisting of two of said optical systems arranged along the second direction.

7. The vehicle light as claimed in claim 6, wherein said second reflecting surfaces of said optical systems of said at least one optical system pair cooperate with each other to form a V-shaped recess opposite to said light output surface in the first direction.

8. The vehicle light as claimed in claim 6, wherein said optical systems include a plurality of said optical system pairs arranged along a third direction transverse to the first direction and the second direction.

9. The vehicle light as claimed in claim 8, wherein said second reflecting surfaces of said optical systems of each of said optical system pairs cooperate with each other to form a V-shaped recess opposite to said light output surfaces in the first direction.

* * * * *